United States Patent [19]

Gomez et al.

[11] 4,269,657

[45] May 26, 1981

[54] FIBROUS PRODUCT CONTAINING CELLULOSIC FIBERS, ITS METHOD OF PREPARATION AND ITS USE, IN PARTICULAR IN THE FIELD OF COVERING PANELS, IN LIEU OF ASBESTOS

[75] Inventors: Daniel Gomez; Giampaolo Bartoli, both of Charavines, France

[73] Assignee: Arjomari-Prioux, Paris, France

[21] Appl. No.: 963,015

[22] Filed: Nov. 22, 1978

[30] Foreign Application Priority Data

Nov. 23, 1977 [FR] France ..... 77 35245

[51] Int. Cl.[3] ..... D21H 1/10

[52] U.S. Cl. ..... 162/135; 162/158; 162/164 R; 162/164 EP; 162/168 N; 162/168 NA; 162/187 R

[58] Field of Search ..... 162/135, 142, 169, 168 R, 162/168 N, 183, 184, 145, 158, 181 R, 164 R, 164 EP, 168 NA; 427/391

[56] References Cited

U.S. PATENT DOCUMENTS

| | | | |
|---|---|---|---|
| 2,657,991 | 11/1953 | Walsh | 162/169 |
| 2,992,963 | 7/1961 | Nagel et al. | 162/135 |
| 3,036,950 | 5/1962 | Martin | 162/14 S |
| 3,812,006 | 5/1974 | Schortmann et al. | 162/169 |

FOREIGN PATENT DOCUMENTS

| | | | |
|---|---|---|---|
| 7620636 | 2/1978 | France . | |
| 399856 | 10/1933 | United Kingdom | 162/142 |
| 1338759 | 11/1973 | United Kingdom | 162/169 |

OTHER PUBLICATIONS

Battista "Synthetic Fibers in Papermaking", (1964), pp. 103–113.

Gelbert "Neoprene Treated Paper", (1962), Dupont Publ.

Casey, *Pulp and Papermaking,* vol. III, (1960), pp. 1950–1953.

*Primary Examiner*—Peter Chin

*Attorney, Agent, or Firm*—Bacon & Thomas

[57] ABSTRACT

The present invention refers to a fibrous product containing cellulosic fibers, which can replace asbestos and comprises in the form of a sheet slightly refined cellulosic fibers in association if the occasion arises, with other fibers, at least one flocculating agent, at least one binder and at least one mineral filler, the said sheet being if the occasion arises, impregnated and smoothed.

The invention likewise refers to the method of preparation of the said fibrous product in accordance with the papermaking techniques.

This fibrous product is useful in the field of covering panels.

23 Claims, No Drawings

FIBROUS PRODUCT CONTAINING CELLULOSIC FIBERS, ITS METHOD OF PREPARATION AND ITS USE, IN PARTICULAR IN THE FIELD OF COVERING PANELS, IN LIEU OF ASBESTOS

BACKGROUND OF THE INVENTION

The present invention refers as a new industrial product to a fibrous product which contains cellulosic fibres and can replace asbestos. It refers likewise to the method of preparation and the use of the said fibrous product, in particular in the field of covering panels. It is aimed in particular at the obtaining of a support comprising cellulosic fibres associated if the occasion arises, with non-cellulosic fibres, having good dimensional and thermal stability, resistance to water and the humidity in the air and intended in particular to replace asbestos in the production of coverings such as ground coverings or "cushion floor" which are designed starting from an asbestos sole.

It is known that the employment of asbestos implies (i) recourse to complicated installations bringing about considerable investment and operational expenses, and (ii) respect for very strict rules of safety and hygiene in order to avoid any risk of absorbtion or inhalation of asbestos fibres and dust.

It is likewise known that if asbestos supports exhibit good properties of dimensional and thermal stability and inputrescibility they do not possess good mechanical properties because they have poor internal cohesion and poor resistance to traction and to tearing.

It is likewise known that it has been proposed to replace asbestos by a fabric comprising cotton and glass wool fibres. Such a fabric displays the disadvantage of being much too stiff.

In order to solve the technical problem of replacement of asbestos a solution is proposed in accordance with the invention, which is different from that of the prior mixture of cotton and glass wool and which calls upon techniques which are purely those of papermaking. Thus the technical solution in accordance with the invention uses conventional papermaking means of manufacture and coating such as flat or inclined or vertical table machines, size-presses, master scrapers, air blades, trailing blades, or rolled coaters and mechanical means such as refining, pressing, and if the occasion arises, smoothing.

SUMMARY OF THE INVENTION

The main objects of the invention are to alleviate the disadvantages of the prior art, in particular those connected with the employment of asbestos, and to propose a fibrous product which can replace asbestos and has interesting properties as far as dimensional and thermal stability, elasticity, internal cohesion and resistance to traction and tearing are concerned. By "fibrous product" is understood here a composite product containing cellulosic fibres in association if the occasion arises, with non-cellulosic fibres.

DETAILED DESCRIPTION OF THE INVENTION

The fibrous product in accordance with the invention is characterized in that it comprises a sheet containing:

(a) slightly refined cellulosic fibres having a Schopper-Riegler degree lying between 15 and 35, in association if the occasion arises, with other fibres, (b) at least one flocculating agent, (c) at least one binder, and (d) at least one mineral filler and if the occasion arises, other additives arising in the paper industry, such as retention agents, pH- regulating agents, dry state resistance agents, colorants and antibiotic substances.

The method of preparation of a fibrous product in accordance with the invention in which papermaking techniques are used, is characterized in that:

(1) an aqueous suspension is caused to flow through a paper machine, which comprises:

(a) slightly refined cellulosic fibres having a Schopper-Riegler degree lying between 15 and 35, in association if the occasion arises, with non-cellulosic fibres, (b) at least one flocculating agent, (c) at least one binder, and (d) at least one mineral filler, in order to obtain the cellulosic product in the form of a sheet; and, if necessary:

(2) the fibrous product thus obtained in a sheet is subjected to a complementary treatment.

It is important from the point of view of the elasticity of the final product that the cellulosic fibres which come into play at Point (a) are slightly refined, that is to say, that they exhibit before the treatment in accordance with the invention a Schopper-Riegler degree (measured after initial refining as a thick paste) lying between 15 and 35 and preferably between 15 and 25. In fact experience shows that if more refined fibres are employed, in particular cellulosic fibres having a Schopper-Riegler degree of 40 to 60 which come into play in a general way in the manufacture of paper, the final product is no longer as elastic as the product in accordance with the invention. From the practical point of view the best results in accordance with the invention are obtained with cellulosic fibres having a Schopper-Riegler degree of 15 to 25 and preferably 20 to 25.

If the occasion arises, non-cellulosic fibres may be associated with the cellulosic fibres. By non-cellulosic fibres are understood here mineral fibres (asbestos excluded) such, in particular, as glass fibres and organic fibres such, in particular, as polyamide and polyester fibres which are dispersible in water and come into play in a conventional fashion in the manufacture of paper.

In practice when cellulosic fibres will be associated with non-cellulosic fibres a quantity will advantageously be employed which is less than or equal to 10 parts by weight of non-cellulosic fibres per 100 parts by weight of cellulosic fibres. In accordance with a preferred embodiment the resistance of the final product to the humid state is improved by employing a mixture of fibres comprising 3 to 6 parts by weight of glass fibres (of 3 to 8 mm in length) and 100 parts by weight of cellulosic fibres.

The flocculating agent (b) fulfills two roles: it ensures the precipitation of the binder onto the fibres by modifying the electric charge of the said fibres and it improves the resistance to the humid state. When the fibres (a) are cellulosic fibres or a mixture of cellulosic fibres with non-cellulosic fibres in which the cellulosic fibres are preponderant, the flocculating agent employed will be an agent for cationisation of the cellulosic fibres in order to render them substantive. Advantageously 1 to 5 parts by weight of commercial substance (b) will be employed per 100 parts by weight of fibres (a). Amongst the flocculating agents which may be employed may be mentioned in particular but nonrestrictively the resins of polyamide type (in particular the polyamide—polyamine—epichlorhydrin resins), ethylene-imine and resins of polyethylene-imine type.

The flocculating agents of Point (b) belong of course to the family of retention agents. However, in what follows it has been preferred rather to distinguish arbitrarily the cationisation agents from the other retention agents, the expression "retention agents" being reserved for the products of Point (f).

The binder or binders (c) the fixation of which to the fibres (a) is favoured by (b) fulfil essentially two functions: To favour the flexibility, the internal cohesion, the dimensional stability in the dry state and in the wet state and the resistance to tearing of the finished product, on the one hand, and to avoid the delamination of the fibrous mats during the treatment of stage (2), on the other hand. Advantageously 5 to 30 parts by weight dry, preferably 10 to 15 parts by weight dry, will be employed of at least one binder (c) designated below by the term "polymer in mass" per 100 parts by weight of fibres (a).

Amongst the binders (c) which are suitable may be mentioned in particular the polymers and copolymers obtained from the following monomers: acrylic acid, methacrylic acid, acrylonitrile, methacrylonitrile, acrylates and methacrylates of alkyl in $C_1$–$C_4$, acrylamide, methacrylamide, N-methylolacrylamide, styrene, butadiene, as well as mixtures of the said polymers and copolymers. In particular there may be employed as binders acrylic acid—acrylonitrile; acrylic acid—acrylonitrile-acrylate—acrylamide, styrene-butadiene, butadiene-acrylonitrile, butadiene-acrylonitrile-methacrylic acid copolymers. By way of non-restrictive examples the following polymers in mass may be employed:

the "polymer A" which contains 87 to 90 parts by weight of ethylacrylate unit, 1 to 8 parts by weight of acrylonitrile unit, 1 to 6 parts by weight of N-methylolacrylamide unit and 1 to 6 parts by weight of acrylic acid unit;

the "polymer B" which contains 60 to 75 parts by weight of ethylacrylate unit, 5 to 15 parts by weight by acrylonitrile unit, 10 to 20 parts by weight of butylacrylate unit, 1 to 6 parts by weight of N-methylolacrylamide unit and 1 to 6 parts by weight of acrylamide unit;

the "polymer C" which contains 60 to 65 parts by weight of butadiene unit, 35 to 40 parts by weight of acrylonitrile unit and 1 to 7 parts by weight of methacrylic acid unit;

the "polymer D" which contains 38 to 50 parts by weight of styrene unit, 47 to 59 parts by weight of butadiene unit, and 1 to 6 parts by weight of methylacrylamide unit;

the "polymer E" which contains 53 to 65 parts by weight of styrene unit, 32 to 44 parts by of butadiene unit and 1 to 6 parts by weight of methylacrylamide unit.

The mineral fillers of Point (d) are identical with those employed in the usual way in the paper industry. In particular calcium carbonate, kaolin and talc are suitable. Advantageously 30 to 60 parts by weight dry will be employed of at least one mineral filler (d), preferably 35 to 50 parts by weight dry per 100 parts by weight of fibres (a).

Other ingredients may be incorporated at Stage (1). It is a matter mainly of ingredients which come into play in an ordinary way in the paper industry, namely:

(e) at least one sizing agent (in order to reduce the absorbtion of water by the fibres) such, in particular, as the anhydrides of dicarboxylic acids, the dimeric alkylketenes and paraffin emulsions (advantageously 0.1 to 2 parts by weight of at least one sizing agent will be employed per 100 parts by weight of fibres (a));

(f) at least one retention agent chosen from the group consisting of:
cationic starch;
retention agents conventional in papermaking, in particular for surface sizing such, for example, as polyacrylic acids, polyacrylamides, polyamines, polyamides, styrene-butadiene copolymers, acrylic acid-acrylonitrile copolymers, butadiene-acrylonitrile copolymers and ammonium salts;
pH-regulating agents in particular for regulating the pH between 6 and 7, such, for example, as aluminium sulphate and aluminium chloride;

(g) at least one lubrication agent, the preferred lubrication agents from Stage (1) in accordance with the invention being fatty acid derivatives so as to favour anti-adherance of the resulting sheet to the wet presses, the felts and the dryer cylinders; and if the occasion arises, (h) other additives such, in particular, as one or more agents for resistance to the dry state such as cold-soluble starch, alginates, mannogalactans and galactomannan ethers, and one or more colorants (those suitable, in particular, according to need, are the acid, basic or direct colorants).

The preferred quantities of substances (f) per 100 parts by weight of fibres (a) are 0.1 to 0.5 parts by weight of cationic starch, 0.1 to 1 part by weight of surface sizing agent and/or 0.5 to 1 part by weight of pH-regulating agent. The preferred quantities of substances (g) per 100 parts by weight of fibres (a) are 0.2 to 4 parts by weight.

The pH-regulating agents of Point (f) fulfill apart from regulation of the pH, other functions: they assist flocculation by favouring the precipitation of the latex, and improve the drainability of the sheet obtained in Stage (1).

The sheet obtained in Stage (1) which has in general a weight of 300 to 600 g/m$^2$ is next advantageously subjected to the complementary treatment of Stage (2) after having been drained and dried.

Stage (2) comprises the impregnation of the sheet by means of a aqueous bath (suspension or dispersion) containing a latex and at least one mineral filler and if the occasion arises, other additives.

The latex is employed in the impregnation bath for reinforcing the mechanical properties and reducing the absorbtion of the sheet with respect to water and the plasticizers of the polyvinyl chloride such as dioctyl phthalate. The latex may be a polymer employed currently in the paper industry for this purpose. For example, one of the substances of Point (c) may be called upon, associated if the occasion arises, with at least one sizing agent of type (e) or with a surface sizing agent as envisaged under Point (f). The polymers A, B, C, D and E, are particularly suitable, as well as their associations with the said agents (e) and (f).

In the aqueous suspension of the impregnation bath the latex is advantageously at a concentration of 400 to 550 g/l.

The mineral filler employed in Stage (2) may be one of the mineral fillers of Point (d). For this purpose it is recommended to employ 10 to 40 parts by weight dry of mineral filler per 100 parts by weight of latex. One may, for example, employ kaolin previously put into aqueous suspension at 650 g/l in the presence of an organic or mineral dispersant agent.

Amongst the additives which it may be advantageous to incorporate in the impregnation bath of Stage (2), may be mentioned in particular the additives α and δ below. Hence the impregnation bath may contain at least one of the said additives and preferably a mixture of at least one additive of each kind.

The mixture preferred for this purpose comprises:

(α) a sizing agent of Points (e) and (f) at the rate of 5 to 10 parts by weight of the said sizing agent per 100 parts by weight of latex (amongst the sizing agents which are suitable here may be mentioned the dimeric alkylketenes and paraffin emulsions);

(β) an anti-foaming agent at the rate of 0.1 to 0.3 part by weight per 100 parts by weight of latex;

(γ) a lubricating agent at the rate of 0.5 to 2 parts by weight of the said agent per 100 parts by weight of latex, the lubricating agent preferred being here ammonium stearate which gives better results than the metallic stearates (Ca and Mg); and (δ) at least one antibiotic substance chosen from the group consisting of the bactericides and the fungicides; advantageously two antibiotics will be employed, one acting mainly as bactericide and the other as fungicide, the preferred proportions of each antibiotic substance being 1500 to 2500 ppm by weight with respect to the weight of the sheet obtained in Stage (1) and, in particular, 1500 to 2500 ppm of bactericide and 1500 to 2500 ppm of fungicide.

With a bactericide and a fungicide one obtains the imputrescible character desired for replacing asbestos. Amongst the antibiotics employable may be mentioned in particular 2-(4-thiazolyl)-benzimidazole, 2-(thiocyanomethylthio)-benzothiazole, zinc pyridinethione, pimaricine, dodecyl-guanidine, methylenebis-thiocyanate, 1,4-bis-(bromoacetoxy)-2-butene and zinc 2-mercaptobenzothiazole, each of these substances being preferably employed at the rate of 1500 to 2500 g per ton of sheet from Stage (1) to be treated.

The preferred way of putting the method in accordance with the invention into effect consists:

At Stage (1): in introducing under agitation into a tank the slightly refined cellulosic fibres and if the occasion arises, other fibres in suspension in water, the flocculating agent, the mineral filler, the dry-resistance agent and if the occasion arises, the colorant substance and an antifoaming agent; this mixture is next transferred into a storage tank whence it is withdrawn continuously into the head circuits of the paper machine; into these head circuits are introduced continuously in succession the polymer in mass (c), the sizing agent (e), the cationic starch, the retention agents conventional in papermaking (mentioned under Point (f)), the pH-regulating agent, (in particular aluminium sulphate) and the lubricating agent; the resultant mixture is introduced into the paper machine and a sheet is obtained that is drained slightly (draining under a linear load lying between 5 kg/cm and 35 kg/cm) and then dried;

At Stage (2): in impregnating the said sheet by means of an aqueous suspension containing latex, the anti-foaming agent, the mineral filler (which has previously been put into aqueous suspension in the presence of a dispersant agent), the sizing agent, the lubricating agent (preferably ammonium stearate), the bactericide and the fungicide.

The technique of Stage (1) offers the advantage of preparing a fibrous sheet continuously without having to fear flocculation of the latex on its own in the head circuits. More precisely in Stage (1) the slightly refined cellulosic fibres are put into suspension in water (between 2 and 4 percent weight/volume) and into the dispersion of the said fibres is introduced dilute (3 to 10 times) flocculating agent, the mineral filler in suspension in water (40 to 70 percent weight/volume) and the other diluted additives (dry resistance agent and if the occasion arises, colorant and anti-foaming agent). The resultant mixture which is at a concentration of the order of 1.5 to 2 percent weight/volume in the water is distributed continuously into the head circuits where there are likewise introduced continuously the binder (a commercial product diluted about 3 to 10 times in the water), the sizing agent (a commercial product diluted 1 to 3 times in the water), the cationic starch (in solution in the water at 1–2 percent weight/volume), the pH-regulator (in solution in the water at 8–15 percent weight weight/volume), the lubricant (if necessary) likewise diluted (to about 10 percent weight/volume) and the retention agents f (undiluted).

The sheet obtained in Stage (1) is drained according to a method known in itself, in particular by means of a device of foil type, vaccuo-foil, rotabelt possibly associated with conventional suction boxes, Pontuseaux, suction cylinders and Millspaugh type.

As indicated above it is important in order to have a thick material to carry out moderate pressing before drying. By working with a headbox concentration of the order of 10 to 20 g/l a sheet comes out (after the suction cylinder) having a dryness of 40 to 50 percent and an overall retention (all of the materials included) which may exceed 80 to 85 percent (if in the headbox one has 100 g of material, water included, one has in dry matter after Millspaugh at least 80 to 85 g).

Of course if one has called upon papermaking devices sufficiently coated with Teflon, it is possible to envisage either reduction in the quantity of lubricating agent or the omission of the said lubricating agent. However that may be, it is safer to employ a lubricating agent in any case, above all for periods of continuous production greater than or equal to three days.

Other advantages and characteristics of the invention will be better understood from the reading which is to follow of examples in no way restrictive but given by way of illustration.

EXAMPLE 1

Stage 1

A sheet is prepared by means of a paper machine from an aqueous suspension comprising for the one part 100 parts by weight of slightly refined 100% cellulosic fibres (Schopper-Riegler degree lying between 15 and 25) and for the other part the following additives:

| | |
|---|---|
| Cold-soluble starch | 2 parts by weight |
| Ethyleneimine | 1 to 4 parts by weight |
| Calcium carbonate | 30 to 60 parts by weight |

-continued

| | |
|---|---|
| Polymer in mass (polymer A) | 5 to 30 parts by weight |
| Dicarboxylic acid anhydride (sizing agent commercialized under the name of "Fibran") | 0.2 to 2 parts by weight |
| Cationic starch | 0.1 to 0.5 parts by weight |
| Retention agent (acrylic acid-acrylamide copolymer) | 0.2 to 1 part by weight |
| Aluminium sulphate | 0.5 to 1 part by weight |
| Lubricating agent (fatty acid derivative) | 0.2 to 4 parts by weight |

A sheet of 300 to 400 g/m$^2$ is obtained which is lightly pressed in the wet portion before drying it.

Stage 2

The sheet from stage 1 is impregnated by means of an aqueous suspension or dispersion of acrylic latex (the said latex being at a concentration of 400 to 550 g/l) comprising:

| | | |
|---|---|---|
| Acrylic latex | 100 parts by weight | |
| Kaolin | 10 to 40 parts by weight | |
| Dimeric alkylketene | 5 to 10 parts by weight | |
| Ammonium stearate | 0.5 to 2 parts by weight | |
| Antifoaming agent | 0.1 to 0.3 parts by weight | |
| Methylene-bis-thiocyanate | 1500 to 2500 ppm | (with respect to the weight of the sheet from Stage 1) |
| 2-(thiocyanomethylthio)-benzothiazole | 1500 to 2500 ppm | |

The absorption desired is from 20 to 30 g/m$^2$ after drying.

EXAMPLE 2

Stage 1

One proceeds as indicated in Example 1 from slightly refined (Schopper-Riegler degree lying between 15 and 25) cellulosic fibres (100 parts by weight) in an aqueous suspension, and from the following additives:

| | |
|---|---|
| Direct colorant | 0.2 to 3 parts by weight |
| Polyamide-polyamine-epichlorhydrin resin | 1 to 4 parts by weight |
| Kaolin | 30 to 60 parts by weight |
| Polymer C | 5 to 30 parts by weight |
| Dimeric alkylketene | 0.2 to 2 parts by weight |
| Cationic starch | 0.1 to 0.5 parts by weight |
| Polyethyleneimine | 0.1 to 1 parts by weight |
| Aluminium sulphate | 0.5 to 1 parts by weight |
| Fatty acid derivative | 0.2 to 4 parts by weight |

A sheet of 300 to 400 g/m$^2$ is obtained which is slightly drained in the wet portion and then dried.

Stage 2

The foregoing sheet is impregnated by means of an aqueous suspension or dispersion of acrylic latex (in which the said latex is at a concentration of 400 to 550 g/l) comprising:

| | | |
|---|---|---|
| Acrylic latex | 100 parts by weight | |
| Kaolin | 10 to 40 parts by weight | |
| Antifoam | 0.1 to 0.3 parts by weight | |
| Paraffin emulsion | 2 to 15 parts by weight | |
| Ammonium stearate | 0.5 to 2 parts by weight | |
| 2-(4-thiazobyl)-benzimidazole | 1500 to 2500 ppm | (with respect to the weight of the sheet of stage 1) |
| 1,4-bis-(bromoacetoxy)-2-butene | 1500 to 2500 ppm | |

The absorption desired is from 20 to 30 g/m$^2$.

EXAMPLE 3

Stage 1

One proceeds as indicated in Example 1 from slightly refined (Schopper-Riegler degree lying between 15 and 25, and preferably between 20 and 25) in an aqueous suspension, and from the following additives:

| | |
|---|---|
| Direct colorant | 0.2 to 3 parts by weight |
| Mannogalactan | 0.2 to 2 parts by weight |
| Polyamide-polyamine-epichlochydrin resin | 1 to 4 parts by weight |
| Kaolin | 30 to 60 parts by weight |
| Polymer A | 5 to 20 parts by weight |
| Dicarboxylic adic anhydride | 0.2 to 2 parts by weight |
| Polyamine-polyamide resin | 0.2 to 1 part by weight |
| Cationic starch | 0.1 to 0.5 parts by weight |
| Aluminium sulphate | 0.5 to 1 part by weight |
| Fatty acid derivative | 0.2 to 4 parts by weight |

A sheet of 300 to 400 g/m$^2$ is obtained which is slightly drained in the wet portion and then dried.

Stage 2

The foregoing sheet is impregnated by means of an aqueous suspension or dispersion of acrylic latex (in which the said latex is at a concentration of 400 to 550 g/l) comprising:

| | | |
|---|---|---|
| Acrylic latex (polymer A) | 100 parts by weight | |
| kaolin | 10 to 40 parts by weight | |
| Antifoaming agent | 0.1 to 0.3 parts by weight | |
| Paraffin emulsion | 2 to 15 parts by weight | |
| Ammonium stearate | 0.5 to 2 parts by weight | |
| 2-(thiocyanomethylthio)-benzothiazole | 1500 to 2500 ppm | (with respect to the weight of the sheet from stage 1) |
| Mixture of zinc pyridinethione and zinc 2-mercaptobenzothiazole (2,5:1) by weight | 1500 to 2500 ppm | |

The absorption desired after drying is from 20 to 30 g/m$^2$.

EXAMPLE 4

A sheet is prepared by means of a paper machine from an aqueous suspension comprising for the one part 100 parts by weight of cellulosic fibres (a mixture of long fibres (resinous wood) and short fibres (deciduous wood) in the ratio by weight (80:20)) having a Schopper-Reigler degree of 20 and for the other part the following additives:

| | |
|---|---|
| Cold-soluble starch | 2 parts by weight |
| Talc | 60 parts by weight |
| Polyamide-polyamine-epichlorhydrin resin | 3 parts by weight |
| Polymer A or E | 15 parts by weight |
| Dimeric alkylketene | 0.2 parts by weight |
| Cationic starch | 0.3 parts by weight |
| Retention agent (acrylic acid-acrylamide copolymer) | 0.2 parts by weight |
| Aluminium sulphate | 0.5 parts by weight |

-continued

| | |
|---|---|
| Lubricant (ammonium stearate) | 1 part by weight |
| Antifoaming agent | 0.1 to 0.3 parts by weight |

A sheet of 300 to 600 g/m$^2$ is obtained which is lightly pressed in the wet portion (under a linear load lying between 5 kg/cm and 35 kg/cm) before drying it.

EXAMPLE 5

The sheet obtained in Example 4 is subjected to impregnation (size press) in accordance with the details described under Stage 2 of Example 2. The absorption desired is from 20 to 30 g/m$^2$.

EXAMPLE 6

A sheet is prepared by means of a paper machine from an aqueous suspension comprising for the one part 100 parts by weight of cellulosic fibres having a Schopper-Reigler degree lying between 15 and 25 and for the other part the following additives:

| | |
|---|---|
| Flocculant | 3 to 4 parts by weight |
| Polymer A | 10 to 15 parts by weight |
| Kaolin | 35 to 50 parts by weight |

NOTE:
The flocculant here is a mixture of polyamine-polyamide-epichlorhydrin resin, polyethyleneimine resin and alum in the ratio by weight (3:0.5:0.5).

The sheet is drained slightly (under a linear load of 5 to 35 kg/cm) and dried in order to obtain a sheet of 300 to 500 g/m$^2$.

The sheet thus obtained has properties similar to those of the sheets of Example 1 (Stage 1), of Example 2 (Stage 1), of Example 3 (Stage 1) and of Example 4 as far as resistance to traction and dimensional stability are concerned. Its absorption of water (Cobb, water 1 minute) of the order of 30 to 40 g/m$^2$ is good with respect to asbestos (30 to 50 g/m$^2$) but higher than that of the sheets from Examples 1 (Stage 1), 2 (Stage 1), 3 (Stage 1) and 4. In order to reduce its absorption of water and thus increase its strength when it is wetted, it may be interesting to subject it to a complementary treatment as described in Example 7 below.

EXAMPLE 7

The sheet obtained in Example 6 is subjected to impregnation in accordance with the details described under Stage 2 of Example 3. The absorption desired is from 20 to 30 g/m$^2$.

EXAMPLE 8

A sheet is prepared by means of a paper machine from an aqueous suspension comprising 100 parts by weight of fibres (a mixture of 95 parts by weight of cellulosic fibres having a Schopper-Reigler degree from 20 to 25, and 5 parts by weight of glass fibres) for the one part, and the following additives for the other part:

| | |
|---|---|
| Flocculant | 4 parts by weight |
| Polymer A | 15 parts by weight |
| Talc | 60 parts by weight |

A sheet of 300 to 600 g/m$^2$ is obtained which is slightly drained in the wet portion and dried. The dried sheet thus obtained has a water-absorbent power from 30 to 35 g/m$^2$ and displays good mechanical properties.

EXAMPLE 9

The sheet from Example 8 is subjected to a complementary treatment in accordance with the details described under Stage 2 of Example 3. This treatment reduces the absorbent power.

EXAMPLE 10

Stage 1

A sheet is prepared by means of a paper machine from an aqueous suspension comprising for the one part 100 parts by weight of fibres (96 parts by weight of cellulosic fibres having a Schopper-Reigler degree of 20, and 4 parts by weight of glass fibres, the cellulosic fibres being a mixture of fibres of resinous wood and fibres of deciduous wood (4:1) by weight) and for the other part the following additives:

| | |
|---|---|
| Cold-soluble starch | 3 parts by weight |
| Mineral filler (talc) | 50 parts by weight |
| Polyamine-polyamide-epichlorhydrin resin | 3 parts by weight |
| Polymer A | 15 parts by weight |
| Dimeric alkylketene | 0.2 parts by weight |
| Cationic starch | 0.4 parts by weight |
| Antifoaming agent | 0.2 parts by weight |
| Retention agent (acrylic acid acrylamide copolymer) | 0.15 parts by weight |
| Lubricant | 2 parts by weight |
| Aluminium sulphate | 0.5 parts by weight |

The sheet is drained slightly in the wet portion and then dried. A sheet of 300 to 600 g/m$^2$ is obtained.

Stage 2

One proceeds in accordance with the operative details of Stage 2 of Example 3 with:

| | |
|---|---|
| Acrylic latex (polymer A) | 100 parts by weight |
| Kaolin | 30 parts by weight |
| Antifoaming agent | 0.1 to 0.3 parts by weight |
| Paraffin emulsion | 2 to 15 parts by weight |
| Ammonium stearate | 0.5 to 2 parts by weight |
| Fungicide and bactericide | (as in Example 3) |

The absorption desired is of the order of 20 to 30 g/m$^2$.

The fibrous products in accordance with the invention and in particular those obtained in accordance with the examples described above have great thickness (greater than 0.5 mm), exhibit good elasticity (elongation under traction in the dry state and wet between 6 and 13%), good thermal stability dry, and in the presence of moisture (modification less than 0.25% in the length direction and the width direction) their tensile strength (greater than 1500 in the two directions in accordance with the French standard NF Q 03004) is three times higher than that of asbestos.

In a general way the fibrous products in accordance with the invention satisfy the French standard NF X 41517 relative to the method of testing fungicide properties and in particular resist the following fungi: *Chaetomium globosum, Myrothecium verrucaria, Stachybotrys atra, Cladosporium herbarum, Peniccillium funiculosum, Trichoderma viride, Sterigmatocystis nigra, Aspergillus flavus, Aspergillus ustus, Paecilomyces varioti.* They likewise satisfy the TAPPI (Trade Association Pulp Paper International) standard T 4490564 relative to the method of testing bacteriological properties.

Part of the results of the measurements which have been undertaken with the fibrous product obtained under Stage 2 of Example 3 is summarized below.

(1) Density

The density is 0.70.

(2) Thickness

The thickness is greater than 525μ.

(3) Tensile strength

The tensile strength (R) has been determined in the two directions on strips 5 cm wide cut out so that the length of the said strips corresponds with the direction of movement (running) of the product in the paper machine and the impregnating machine.

R(direction of run)=17 kg

R(cross direction)=10 kg

The elongation under traction is of the order of 6 to 13% in the two directions.

(4) Absorption of water

If one face of the product from Example 3 is put into contact with water (in accordance with the method of testing of the French standard NF Q 03018), it is found that the quantity of liquid absorbed is small and of the order of 10 to 18 g/m$^2$.

(5) Dimensional stability

The dimensional stability (SD) has been determined in the two directions, with various durations and temperatures of exposure:

SD(3 min at 180° C.)<0.25% in both directions

SD(6 hrs at 80° C.)<0.25% in both directions

SD(24 hrs in a tropical oven at 90% humidity-)<0.25% in both directions

For comparison, asbestos under the same operation conditions gave the following results:

| | |
|---|---|
| Density | 0.87 |
| Tensile strength | 2.5 kg in both directions |
| Absorption of water | 30 to 50 g/m$^2$ |
| Dimensional stability | less than 0.25% in both directions. |

Table I given below, which deals with the water-absorbent power, shows the influence of the treatments on the absorbent power.

TABLE I

| PRODUCT | Absorption of water | Cobb (water; 1 minute) |
|---|---|---|
| Example 1 | (Stage 1) | 25–30 g/m$^2$ |
| Example 1 | (Stage 2) | 10–20 g/m$^2$ |
| Example 2 | (Stage 1) | 20–25 g/m$^2$ |
| Example 2 | (Stage 2) | 10–18 g/m$^2$ |
| Example 3 | (Stage 1) | 20–25 g/m$^2$ |
| Example 3 | (Stage 2) | 10–18 g/m$^2$ |
| Example 4 | | 20–25 g/m$^2$ |
| Example 5 | | 10–15 g/m$^2$ |
| Example 6 | | 30–40 g/m$^2$ |
| Example 7 | | 10–20 g/m$^2$ |
| Example 8 | | 30–35 g/m$^2$ |
| Example 9 | | 10–20 g/m$^2$ |
| Asbestos | | 30–50 gm$^2$ |

Finally, the fibrous products in accordance with the invention are useful for the manufacture of covering panels. In this application they are coated with polyvinyl chloride and after such coating may be subjected to expansion in relief in order to provide decorative panels of "cushion floor" type.

We claim:

1. A method of preparation of a fibrous cellulosic fibers-containing product having good dimensional and thermal stability, elasticity and resistance to traction and tearing which comprises the steps of (a) producing a flow of an aqueous suspension through a machine of the paper-making type, the aqueous suspension comprising:

100 parts by weight of fibers selected from the group consisting of (i) slightly refined cellulosic fibers having a Schopper-Reigler degree comprised between 15 and 35, and (ii) mixtures of said slightly refined cellulosic fibers with non-cellulosic fibers in which the weight ratio of non-cellulosic fibers to cellulosic fibers is lower than or equal to 0.1, 1 to 5 parts by weight of a cationic polymeric flocculating agent, 5 to 30 parts by weight of an organic polymeric binder, and 30 to 60 parts by weight of an inorganic filler, to form a wet sheet, (b) draining the wet sheet under a linear load of 5 to 35 kg/cm, and (c) drying the drained sheet.

2. A method of preparation of a fibrous cellulosic fibers-containing product having good dimensional and thermal stability, elasticity and resistance to traction and tearing which comprises the steps of (a) producing the flow of an aqueous suspension through a machine of the paper-making type, said aqueous suspension comprising:

100 parts by weight of fibers selected from the group consisting of (i) slightly refined cellulosic fibers having a Schopper-Reigler degree comprised between 15 and 35, and (ii) mixtures of said slightly refined cellulosic fibers with non-cellulosic fibers in which the weight ratio of the non-cellulosic fibers to cellulosic fibers is lower than or equal to 0.1, 1 to 5 parts by weight of cationic polymeric flocculating agent, 5 to 30 parts by weight of organic polymer binder, and 30 to 60 parts by weight of inorganic filler, to form a wet sheet;

(b) draining the wet sheet;

(c) drying the wet sheet;

(d) treating the surface of the dried sheet thus obtained with an aqueous bath containing 400 to 550 g/l of a latex and an inorganic filler; and (e) drying the treated sheet.

3. The method according to claim 2, wherein the draining step (b) is carried out under a linear load of 5 to 25 kg/cm.

4. The method according to claim 2, wherein step (d) is carried out with 10 to 40 parts by weight of inorganic filler for 100 parts by weight of latex.

5. The method according to claim 1 or 2, wherein the cellulosic fibers have a Schopper-Reigler degree of 15 to 25.

6. The method according to claim 5, wherein the cellulosic fibers have a Schopper-Reigler degree of 20 to 25.

7. The method according to claim 1 or 2, wherein the non-cellulosic fibers are glass fibers, the weight ratio of glass fibers to cellulosic fibers being comprised between 0.03 and 0.06.

8. The method according to claim 1 or 2, wherein the aqueous suspension further comprises at least one substance selected from the group consisting of:

a sizing agent, a retention agent, pH-regulating agents, and a lubricating agent.

9. The method according to claim 8, wherein the lubricating agent is a fatty acid derivative.

10. The method according to claim 1 or 2, wherein the flow of the aqueous suspension is continuous.

11. The method according to claim 2, wherein in step (d) the aqueous bath comprises at least one antibiotic substance and contains 100 parts by weight of a latex, 10 to 40 parts by weight of an inorganic filler, 5 to 10 parts by weight of a sizing agent, 0.1 to 0.3 parts by weight of an anti-foaming agent and 0.5 to 2 parts by weight of a lubricating agent.

12. The method according to claim 11, wherein the lubricating agent is ammonium stearate.

13. The method according to claim 1 or 2, wherein the binder is a polymer in mass comprising a polymer, copolymer or mixtures thereof; said polymer or copolymer is formed from acrylic acid, methacrylic acid, acrylonitrite, methacrylonitrite, acrylates, methacrylates of $C_1$–$C_4$, acrylamide, methacrylamide, N-methylolacrylamide, styrene or butadiene monomers; the flocculating agent is a polyamide, ethylene-imine or polyethylene-imine type resin; and the inorganic filler is calcium carbonate, kaolin or talc.

14. A fibrous cellulosic fibers-containing product having good dimensional and thermal stability, elasticity and resistance to traction and tearing and which is useful for replacing asbestos in the field of coverings, which fibrous product is in the form of a sheet and comprises:

(a) fibers selected from the group consisting of (i) slightly refined cellulosic fibers having a Schopper-Reigler degree of 15 to 35, and (ii) mixtures of said cellulosic fibers with non-cellulosic fibers in which the weight ratio of non-cellulosic fibers to cellulosic fibers is lower than or equal to 0.1;

(b) 1 to 5 parts by weight of cationic polymeric flocculating agent per 100 parts by weight of fibers;

(c) 5 to 30 parts by weight of organic polymeric binder per 100 parts by weight of fibers;

(d) 30 to 60 parts by weight of inorganic filler per 100 parts by weight of fibers.

15. A fibrous product according to claim 14 in the form of a sheet, which further comprises an impregnation mixture derived from an aqueous impregnating bath containing 500 to 550 g/l of latex and containing 100 parts by weight of latex 10 to 40 parts by weight of inorganic filler, and dried.

16. A product according to claim 14 in the form of a sheet weighing from 300 to 600 g/m$^2$ and containing per 100 parts by weight of the fibers:

(a) 1 to 5 parts by weight of the flocculating agent;

(b) 5 to 20 parts by weight of the binder;

(c) 30 to 60 parts by weight of the inorganic filler; and (d) 0.1 to 2 parts by weight of sizing agent;

(e) 0.1 to 0.5 parts by weight of cationic starch; and (f) 0.1 to 1 part by weight of a pH-regulatory agent.

17. A fibrous product according to claim 14 in the form of a sheet weighing 300 to 600 g/m$^2$ and containing per 100 parts by weight of the fibers:

(a) 1 to 5 parts by weight of the flocculating agent;

(b) 5 to 20 parts by weight of the binder;

(c) 30 to 60 parts by weight of the inorganic filler;

(d) 0.1 to 2 parts by weight of sizing agent;

(e) 0.1 to 0.5 parts by weight of cationic starch;

(f) 0.1 to 1 part by weight of a pH-regulating agent; and (g) 0.2 to 4 parts by weight of a lubricating agent.

18. A fibrous product according to claim 16 or 17, in the form of a sheet which comprises 20 to 30 g/m$^2$ by dry weight of a surface finishing product derived from an aqueous impregnation bath containing 400 to 550 g/l of a latex, said bath comprising at least one antibiotic substance and containing per 100 parts by weight of latex:

10 to 40 parts by weight of an inorganic filler; 0.1 to 0.3 parts by weight of an antifoaming agent; and 0.5 to 2 parts by weight of a lubricating agent.

19. A fibrous product according to claim 18 which further comprises polyvinyl chloride coating.

20. A fibrous product according to claim 14, wherein the binder is a copolymer which contains 87 to 90 parts by weight of ethylacrylate unit, 1 to 8 parts by weight of acrylonitrite unit, 1 to 6 parts by weight of N-methylolacrylamide unit and 1 to 6 parts by weight of acrylic acid unit or a copolymer which contains 60 to 75 parts by weight of ethylacrylate unit, 5 to 15 parts by weight of acrylonitrite unit, 10 to 20 parts by weight of butylacrylate unit, 1 to 6 parts by weight of N-methylolacrylamide unit and 1 to 6 parts by weight of acrylamide unit. The flocculant is a polyamide-polyamine-epichlorhydrin resin and the filler is talc.

21. A fibrous product according to claim 14, wherein the flocculant is a mixture of polyamine-polyamide-epichlorhydrin resin, polyethyleneimine resin and alum; the binder is a polymer which contains 87 to 90 parts by weight of ethylacrylate unit, 1 to 8 parts by weight of acrylonitrite unit, 1 to 6 parts by weight of N-methylolacrylamide unit and 1 to 6 parts by weight of acrylic acid unit and the inorganic filler is kaolin.

22. A fibrous cellulosic fibers-containing product according to claim 14, wherein the binder is a copolymer containing 87 to 90 parts by weight of ethylacrylate unit, 1 to 8 parts by weight of acrylonitrite unit, 1 to 6 parts by weight of N-methylolacrylamide unit and 1 to 6 parts by weight of acrylic acid unit and the inorganic filler is talc.

23. A fibrous product according to claim 20, 21 or 22, in the form of a sheet which comprises 20 to 30 g/m$^2$ by dry weight of a surface finishing product derived from an aqueous impregnation bath containing 400 to 550 g/l of a latex, said bath comprising at least one antibiotic substance and containing per 100 parts by weight of latex:

10 to 40 parts by weight of an inorganic filler; 0.1 to 0.3 parts by weight of an antifoaming agent; and 0.5 to 2 parts by weight of a lubricating agent.

* * * * *